US006460716B1

(12) United States Patent
Wong

(10) Patent No.: US 6,460,716 B1
(45) Date of Patent: Oct. 8, 2002

(54) CONTAINER WITH FOOD SEALS

(76) Inventor: Nancy Wong, c/o Alliance Imorts 8000 Cooper Ave., Bldg. 38, Glendale, NY (US) 11385

( * ) Notice: Subject to any disclaimer, the term of this patent is extended or adjusted under 35 U.S.C. 154(b) by 0 days.

(21) Appl. No.: 09/855,823

(22) Filed: May 15, 2001

(51) Int. Cl.[7] ..... B65D 6/28
(52) U.S. Cl. ..... 220/4.24; 220/780
(58) Field of Search ..... 220/4.24, 4.26, 220/4.21, 192, 780–794; 206/505, 508

(56) References Cited

U.S. PATENT DOCUMENTS 4,555,043 * 11/1985 Bernhardt ..... 220/257.1
5,730,311 * 3/1998 Curtis ..... 206/508
5,915,581 * 6/1999 Pfirrmann et al. ..... 194/207
6,032,827 * 3/2000 Zettle et al. ..... 220/784
6,056,138 * 5/2000 Chen ..... 206/505
6,168,044 * 1/2001 Zettle et al. ..... 220/784
6,170,696 * 1/2001 Tucker et al. ..... 206/508
6,196,404 * 3/2001 Chen ..... 206/505

* cited by examiner

*Primary Examiner*—Lee Young
*Assistant Examiner*—Lien T M Ngo
(74) *Attorney, Agent, or Firm*—Bierman, Muserlian and Lucas

(57) ABSTRACT

A plastic food container has a lid and a base, each of which has a flange and an inverted U-shaped rim. The flanges and rims mate to form four seals with the rim forming a large horizontal seal and two air pockets between seals to allow for easy opening.

6 Claims, 4 Drawing Sheets

CONTAINER WITH FOOD SEALS

BACKGROUND OF INVENTION

1. Field of Invention

This invention relates to containers and, more particularly, to food containers which are made from molded plastic and used for take-out food.

2. Art Relating to Invention

Plastic food containers typically have a base with tall side walls and a lid with short side walls. The two mate along their respective rims to form a seal. They are made in a simple molding process from plastic and, although reusable by the customer, are not returned to the restaurant.

These containers must be reusable, or resealable so that leftovers can be stored in the same container. The seal must be flexible enough to allow for fairly easy opening and closing, yet tight enough to provide a secure seal against either leakage of food from the container or introduction of air and microbes into the container to prevent spoiling. Thus, there is a balance between providing a strong solid seal and a removable seal.

Also, it is important that the container have a rim that extends out from the body of the container to allow the user to hold the container without burning his hands on the hot food. Since the containers are made of thin plastic, the body of the container provides little or no insulation between the hands of the user and the hot food inside the container. Thus, the rim of the container must be wide enough and strong enough to be grasped by the user and support the food-ladened container.

It is also important that the containers be stackable, one on top of the other.

The art relating to plastic, molded food containers with resealable lids is plentiful, see for example, U.S. Pat. Nos. 6,056,138; 5,833,116; 5,758,791; 5,395,003; 5,377,860; 5,356,026; 4,844,263; 4,555,043; 4,360,118; 4,042,143; 3,861,433; and 2,798,631. Each of these references have different sealing arrangements between the lid and the base.

SUMMARY OF INVENTION

A unique sealing arrangement has now been discovered for use with a plastic molded food container. Specifically, a plastic molded food container with four seals has been found to provide a good, secure sealing arrangement to prevent leakage of food and to prevent spoilage from air and microbes while still providing for easy removal of the lid and resealing of the lid. The four seals include an exterior seal, two middle seals and an interior seal, where one of the middle seals has a surface area equal to or greater than any of the other three seals. Additionally, by making this large middle seal in a horizontal orientation, the rim of the container extends out enough to allow the user to hold the container without burning fingers.

Broadly, the plastic molded food container of the present invention can be characterized as comprising (A) a base having
- (i) a substantially planar bottom;
- (ii) base side walls extending substantially vertically upward from said bottom;
- (iii) a base flange extending substantially horizontally outward from said base side walls;
- (iv) an inverted, U-shaped base rim extending outward from said base flange, said base rim having
  - (a) an inner base rim surface which extends substantially vertically upward from said base flange;
  - (b) a middle base rim surface which extends substantially horizontally outward from inner base rim surface;
  - (c) an exterior base rim surface which extends substantially vertically downward from said middle base rim surface;

(B) a lid having
- (i) a substantially planar top;
- (ii) lid side walls extending substantially vertically downward from said top;
- (iii) a lid flange extending substantially horizontally outward from said lid side walls;
- (iv) an inverted, U-shaped lid rim extending outward from said lid flange and mating with said inverted, U-shaped base rim when said lid is locked onto said base, said lid rim having
  - (a) an inner lid rim surface which extends substantially vertically upward from said lid flange;
  - (b) a middle lid rim surface which extends substantially horizontally outward from said inner lid rim surface;
  - (c) an exterior lid rim surface which extends substantially vertically downward from said middle lid rim surface;

(C) a locking lip which extends vertically downward from said exterior lid rim surface and locks said lid onto said base;

(D) four seals which form when said lid is locked onto said base, said four seals being
- (i) a horizontal inner seal formed by said lid flange and said base flange;
- (ii) a vertical middle seal formed by said inner base rim surface and said inner lid rim surface;
- (iii) a horizontal middle seal formed by said middle base rim surface and said middle lid rim surface;
- (iv) a vertical exterior seal formed by said exterior base rim surface and said exterior lid rim surface;

(E) two air pockets formed between said four seals, a first air pocket formed between said horizontal inner seal and said vertical middle seal, and a second air pocket formed between said vertical middle seal and said horizontal middle seal; and (F) said horizontal middle seal having a surface area equal to or greater than said horizontal inner seal, said vertical middle seal, and said vertical exterior seal.

Preferably, the horizontal middle seal is greater than said horizontal inner seal, said vertical middle seal, and said vertical exterior seal, taken individually.

In order to provide a good seal, it is preferred that said horizontal middle seal and said vertical exterior seal are continuous, in other words, the corner between these two flat seals is also a seal.

In order to make the food container of the present invention stackable, the plastic food container of the present invention can be further characterized as the lid further comprising a raised central portion on said planar top and said base further comprises a raised central portion on said planar bottom which is matable with said raised central portion of said planar top when one container is stacked on another container.

BRIEF DESCRIPTION OF DRAWINGS

These and other aspects of the present invention may be more fully understood by reference to one or more of the following drawings wherein.

DETAILED DESCRIPTION OF INVENTION

Figure 1:
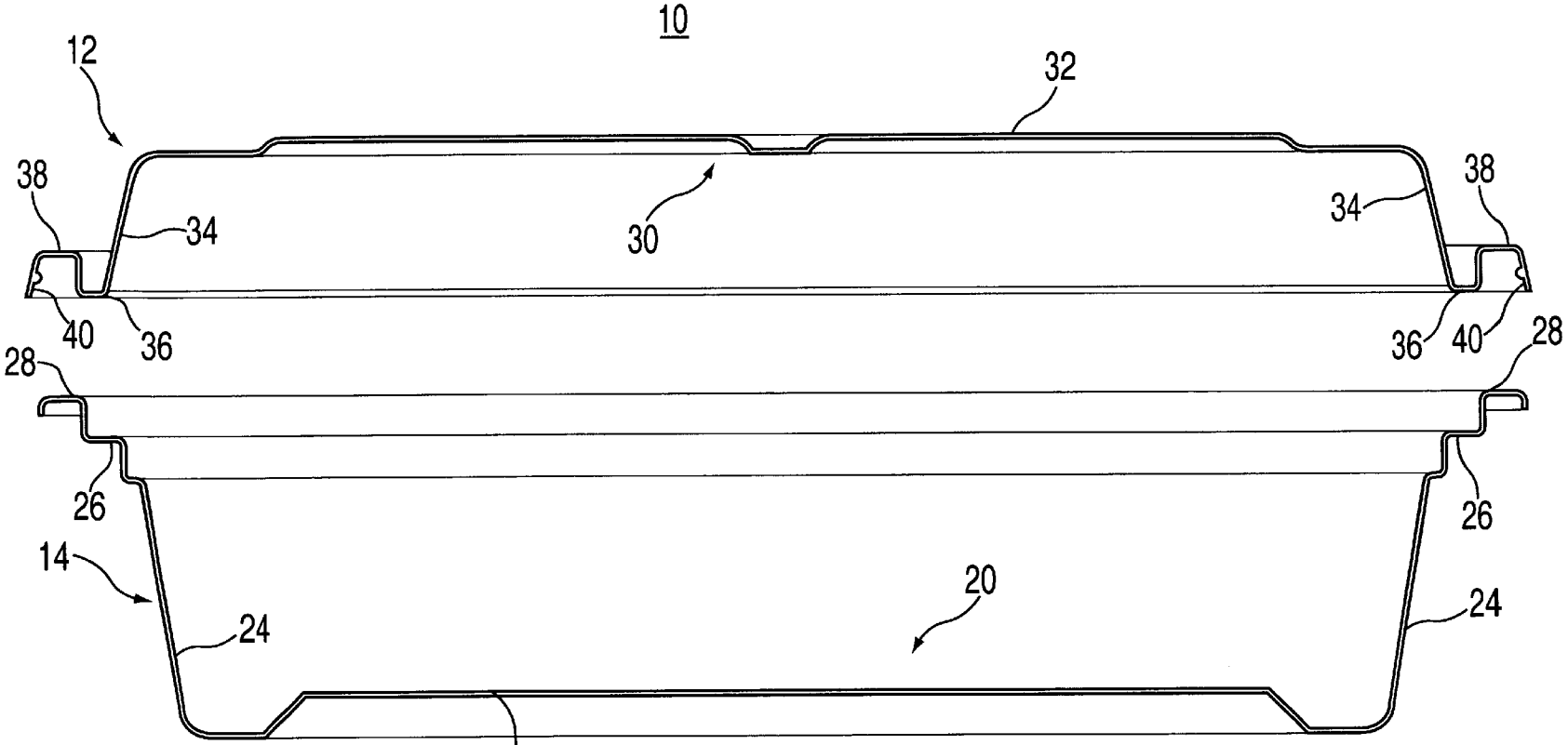
FIG. 1 illustrates a side view of the container of the present invention.
Figure 2:
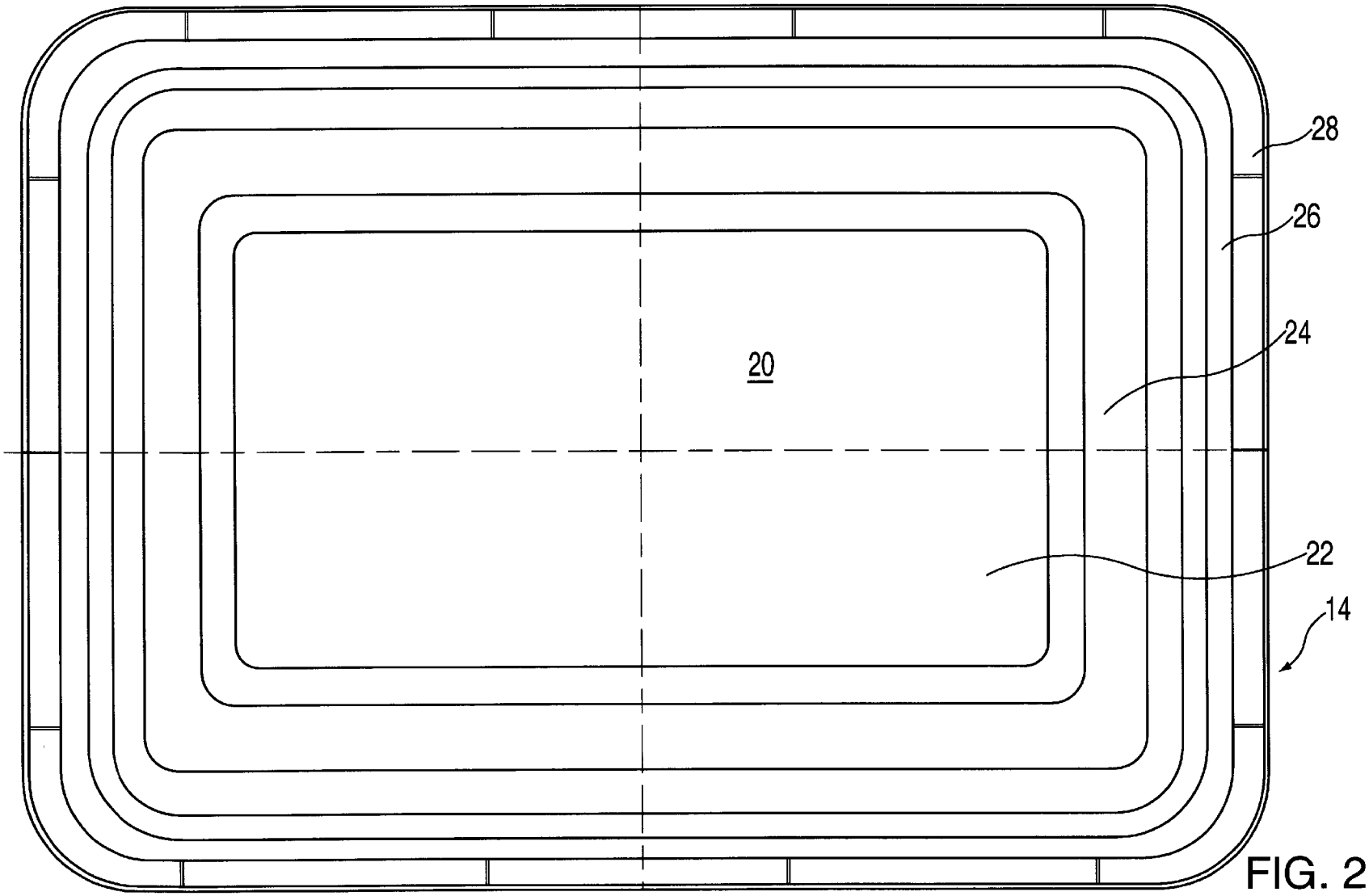
FIG. 2 illustrates a top view of the base of the container.
Figure 3:
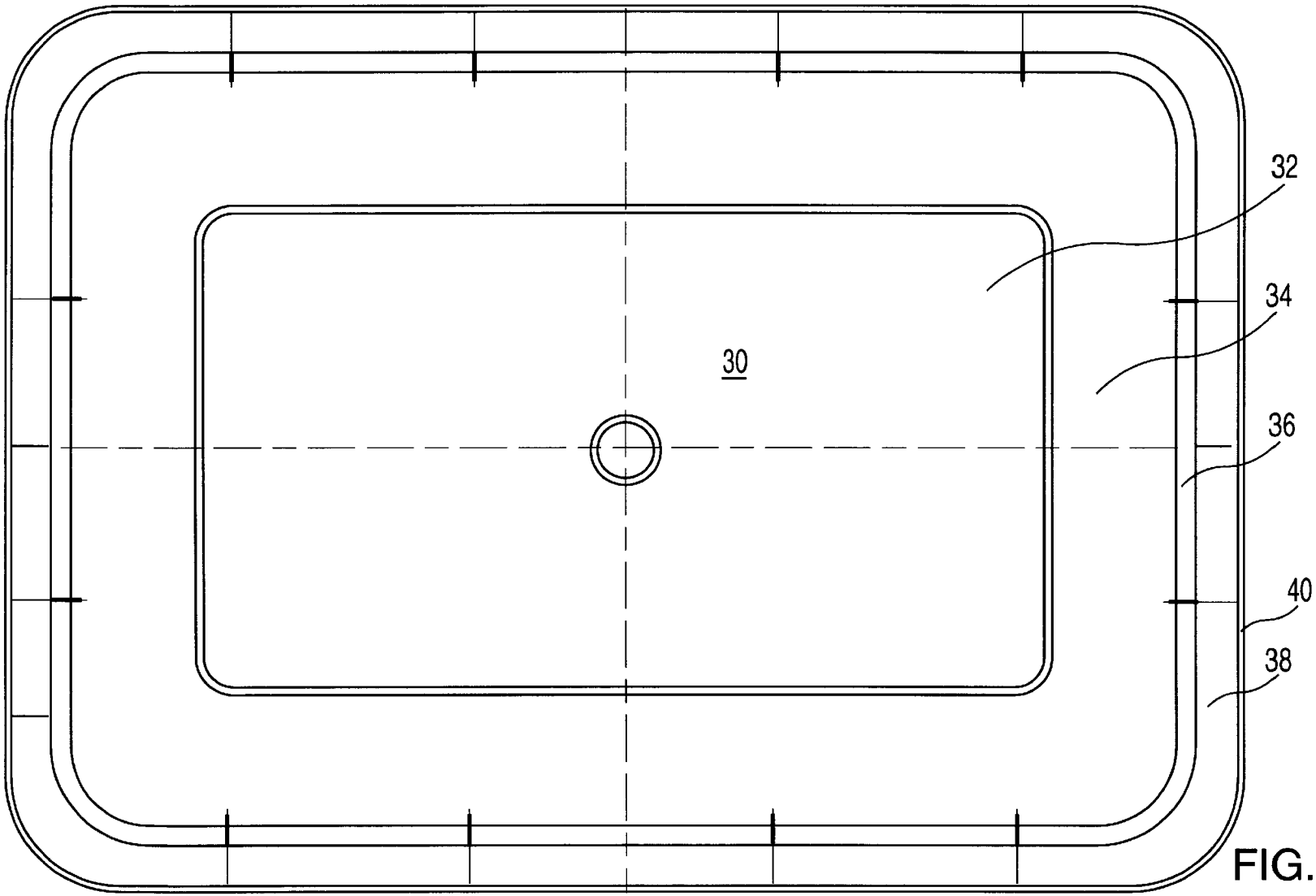
FIG. 3 illustrates a top view of the lid of the container.

Referring to FIG. 1, container 10 has lid 12 and base 14. Base 14 has planar bottom 20, with raised central portion 22, base side walls 24, base flange 26 and base rim 28. Lid 12 has planar top 30 with raised center portion 32, lid side walls 34, lid flange 36, lid rim 38 and locking lip 40. A top view of base 14 can be seen in FIG. 2 while a top view of base 12 can be seen in FIG. 3.

Figure 4:
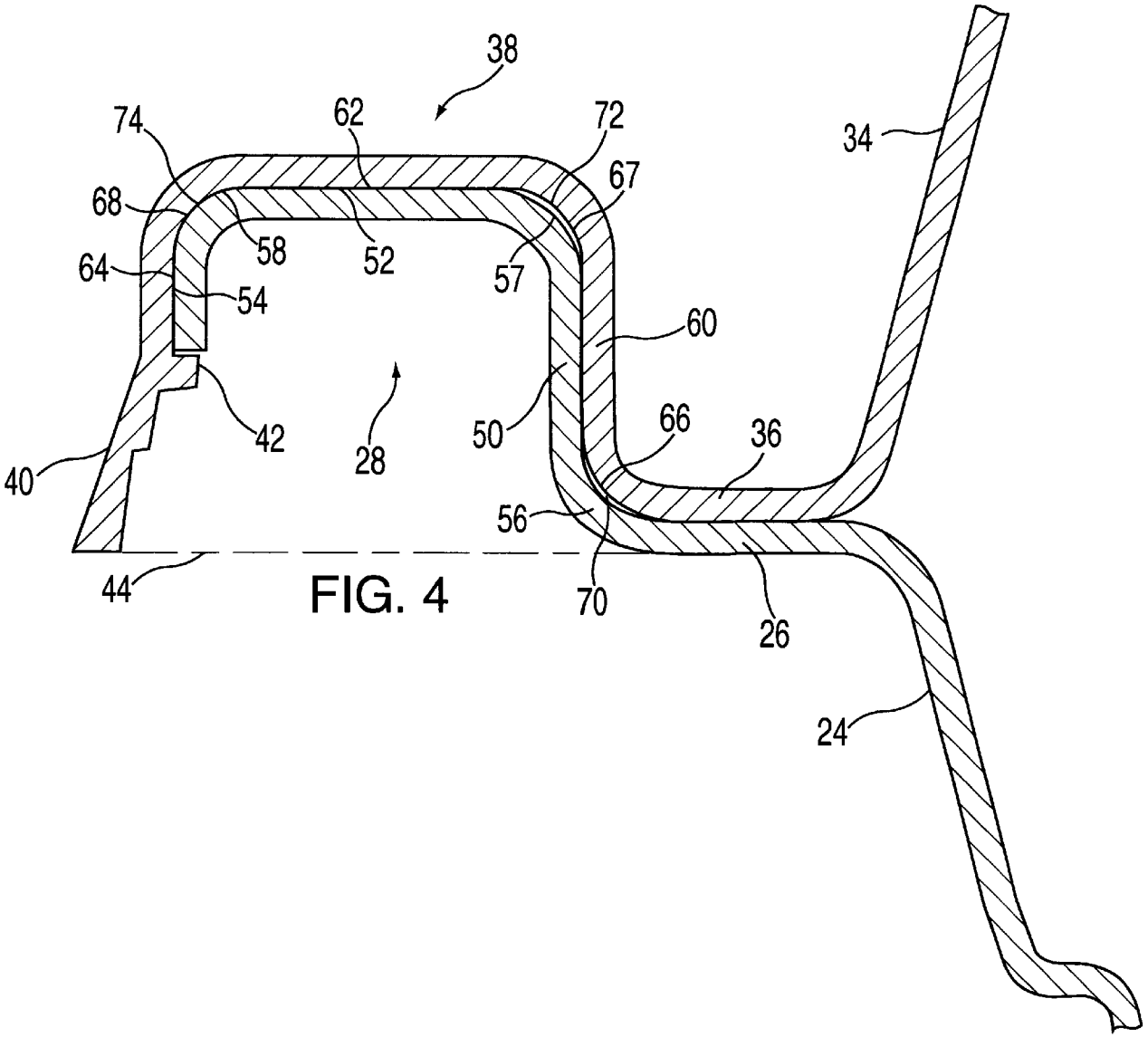
FIG. 4 illustrates a side view of the preferred sealing arrangement of the container.

A detailed view of the sealing arrangement of the present invention is shown in FIG. 4. First, focusing on the sealing arrangement portion of base 14 extending horizontally outward from base side wall 24 is base flange 26. Extending horizontally outward from base flange 26 is base rim 28. Base rim 28 has an inverted, U-shape and comprises inner base rim surface 50 which extends vertically upward from base flange 26, middle base rim surface 52 which extends horizontally outward from inner base rim surface 50, and exterior base rim surface 54 which extends vertically downward from middle base rim surface 52. Surfaces 50, 52 and 54 are flat as is the upper surface of flange 26.

Connecting the flat surface of base flange 26 and base rim 28 is a 90° arcuate corner. Specifically, the flat upper surface of flange 26 is connected to surface 50 by inner base rim corner surface 56. Connecting surface 50 to surface 52 is middle base rim corner surface 57. Connecting surface 52 to surface 54 is exterior base rim corner surface 58.

Turning now to the sealing arrangement portion of lid 12, extending horizontally outward from lid side wall 34 is lid flange 36. Extending horizontally outward from lid flange 36 is lid rim 38. Lid rim 38 has an inverted U-shape and comprises inner lid rim surface 60 which extends vertically upward from lid flange 36, middle lid rim surface 62 which extends horizontally outward from inner lid rim surface 60, and exterior lid rim surface 64 which extends vertically downward from base lid surface 52. Surfaces 60, 62 and 64 are flat as is the lower surface of flange 36.

Connecting the flat surface of lid flange 36 and lid rim 38 is a 90° arcuate corner. Specifically, the flat lower surface of flange 36 is connected to surface 60 by inner lid rim corner surface 66. Connecting surface 60 to surface 62 is middle lid rim corner surface 67. Connecting surface 62 to surface 64 is exterior lid rim corner surface 68.

A horizontal inner seal is formed when the upper surface of flange 26 contacts the lower surface of flange 36. A vertical middle seal is formed when surface 50 contacts surface 60. A horizontal middle seal is formed when surface 52 contacts surface 62, and a vertical exterior seal is formed when surface 54 contacts surface 64.

Also, a fifth preferred seal, outer rim corner seal 74, forms when the exterior rim corner of lid 12 makes contact with exterior rim corner of base 14, specifically when surface 58 contacts surface 68. In essence, this makes a continuous seal between the middle horizontal seal and the vertical exterior seal.

In order to provide for easy opening, two air pockets are built into the sealing arrangement of the present invention. Specifically, inner rim air pocket 70 is defined by the space between surfaces 56 and 66 while middle rim corner air pocket 72 is provided by surfaces 57 and 67. As can be seen in FIG. 4, air pockets 72 and 74 are formed at the inner and middle corners of the rims when the lid rim and base rim are jointed together. These air pockets counter-balance the strength of the seals and allow for easy opening.

In order to lock base 14 to lid 12, locking lip 40 has an inside edge 42 which extends under the end of base rim 28. Preferably, ledge 42 has a length equal to the thickness of the base rim shown in FIG. 4.

Preferably, locking lip 40 extends vertically downward from the end of lid rim 38 a distance such that the end of locking lip 40 is in the same horizontal plane as the lower surface of base flange 26 as shown by site line 44. By having the end of locking lip 40 in the same horizontal plane as the lower surface of base flange 26, a user can easily carry the food-ladened container by its edge, i.e. by the flange and the rim.

In order to make the containers stackable, one on top of the other, base 14 has raised center portion 22. Raised center portion 22 is larger in horizontal area and taller in vertical distance than raised center portion 22 such that raised center portion 22 fits inside raised center portion 32. The differences in size and dimension of the two raised center portions is evident from viewing FIGS. 1–3.

Container 10 is made of plastic in a conventional way using conventional equipment. Good results have been obtained by injection molding. Flange 36 and rim 38 of lid 12 are molded so as to mate with flange 26 and rim 28 of base 14. As shown in FIGS. 1 and 4, the container has a thin wall, suitably about 0.5 mm thick.

The horizontal middle seal formed by surfaces 52 and 62 has a surface area that is equal to or greater than the surface area of any of the other seals. Thus, for example, it is possible for the horizontal middle seal to have a surface area larger than the vertical exterior seal but equal to the surface area of each of the vertical middle seal and horizontal inner seal. Any such combination and/or permutation is possible provided the horizontal middle seal has a surface area equal to or greater than any of the other seals, taken individually. It is preferred, as shown in FIGS. 1 and 4, that the horizontal middle seal has a surface area that is greater than any of the other seals. This large seal area becomes even larger when the corner seal between surfaces 58 and 68 join the horizontal middle seal with the vertical exterior seal.

It will be understood that the claims are intended to cover all changes and modifications of the preferred embodiments of the invention herein chosen for the purpose of illustration which do not constitute a departure from the spirit and scope of the invention.

What is claimed is:

1. A plastic, molded food container having four seals comprising:

(A) a base having
- (i) a substantially planar bottom;
- (ii) base side walls extending substantially vertically upward from said bottom;
- (iii) a base flange extending substantially horizontally outward from said base side walls;
- (iv) an inverted, U-shaped base rim extending outward from said base flange, said base rim having
  - (a) an inner base rim surface which extends substantially vertically upward from said base flange;
  - (b) a middle base rim surface which extends substantially horizontally outward from inner base rim surface;
  - (c) an exterior base rim surface which extends substantially vertically downward from said middle base rim surface;

(B) a lid having
  (i) a substantially planar top;
  (ii) lid side walls extending substantially vertically downward from said top;
  (iii) a lid flange extending substantially horizontally outward from said lid side walls;
  (iv) an inverted, U-shaped lid rim extending outward from said lid flange and mating with said inverted, U-shaped base rim when said lid is locked onto said base, said lid rim having
    (a) an inner lid rim surface which extends substantially vertically upward from said lid flange;
    (b) a middle lid rim surface which extends substantially horizontally outward from said inner lid rim surface;
    (c) an exterior lid rim surface which extends substantially vertically downward from said middle lid rim surface;

(C) a locking lip which extends vertically downward from said exterior lid rim surface and locks said lid onto said base;

(D) four seals which form when said lid is locked onto said base, said four seals being
  (i) a horizontal inner seal formed by said lid flange and said base flange;
  (ii) a vertical middle seal formed by said inner base rim surface and said inner lid rim surface;
  (iii) a horizontal middle seal formed by said middle base rim surface and said middle lid rim surface;
  (iv) a vertical exterior seal formed by said exterior base rim surface and said exterior lid rim surface;

(E) two air pockets between said four seals, a first air pocket formed between said horizontal inner seal and said vertical middle seal, and a second air pocket formed between said vertical middle seal and said horizontal middle seal; and (F) said horizontal middle seal having a surface area equal to or greater than said horizontal inner seal, said vertical middle seal and said vertical exterior seal.

2. The container of claim 1 wherein said lid further comprises a raised central portion on said planar top and said base further comprises a raised central portion on said planar bottom which is matable with said raised central portion of said planar top when one container is stacked on another container.

3. The container of claim 1 wherein said horizontal middle seal and said vertical exterior seal are continuous.

4. The container of claim 1 wherein said vertical middle seal has a surface area greater than said vertical exterior seal.

5. The container of claim 1 wherein when said lid is locked onto said base, said locking lip does not extend vertically below said base flange.

6. The container of claim 1 wherein said horizontal middle seal has a surface area greater than said horizontal inner seal, said vertical middle seal, and said vertical exterior seal.

* * * * *